US008220677B2

(12) United States Patent
Liang

(10) Patent No.: US 8,220,677 B2
(45) Date of Patent: Jul. 17, 2012

(54) WHISTLE ATTACHMENT SYSTEM

(75) Inventor: Ezra Liang, San Francisco, CA (US)

(73) Assignee: The North Face Apparel Corp., Wilmington, DE (US)

( * ) Notice: Subject to any disclaimer, the term of this patent is extended or adjusted under 35 U.S.C. 154(b) by 437 days.

(21) Appl. No.: 12/610,859

(22) Filed: Nov. 2, 2009

(65) Prior Publication Data

US 2011/0101053 A1 May 5, 2011

(51) Int. Cl.
*A45F 3/14* (2006.01)

(52) U.S. Cl. ..... 224/254; 224/255; 224/271

(58) Field of Classification Search ..... 224/182, 224/254, 255, 257–258, 271, 272, 650
See application file for complete search history.

(56) References Cited

U.S. PATENT DOCUMENTS

| | | | | |
|---|---|---|---|---|
| 1,141,992 | A * | 6/1915 | Toelcke | 24/13 |
| 2,743,894 | A * | 5/1956 | Ostnas | 248/317 |
| 2,789,742 | A * | 4/1957 | De Salvo | 224/271 |
| 6,109,490 | A * | 8/2000 | Caluori | 224/220 |
| 2005/0279787 | A1 * | 12/2005 | Davis | 224/232 |

* cited by examiner

*Primary Examiner* — Justin Larson
*Assistant Examiner* — Adam Waggenspack
(74) *Attorney, Agent, or Firm* — Kenyon & Kenyon LLP

(57) ABSTRACT

The present invention provides whistle attachment systems having a fixed component, a free component, two attachment mechanisms connecting the free component to the fixed component. The fixed component includes a piping piece and a flange. The free component of the whistle attachment system includes a whistle and a receiving portion, having a longitudinal axis, connected to the whistle. The receiving portion includes a longitudinal cavity configured to receive the piping piece and a slot configured to receive the flange, which form the first attachment mechanism. The second attachment mechanism includes a flexible member connecting the free component to the fixed component.

20 Claims, 5 Drawing Sheets

WHISTLE ATTACHMENT SYSTEM

TECHNICAL FIELD

The present invention generally relates to whistle attachment systems.

BACKGROUND

Backpacks, vests, or other products having an attached whistle have numerous advantages in a variety of applications. Rather than having to carry a whistle in hand, a user may store the whistle in a pack or on a vest and retrieve it when necessary. For example, while hunting, a user may wish to have easy, speedy access to a hunting whistle to attract game or to scare off other animals. In other situations, a user may wish to have a panic whistle available as quickly as possible in the event of a dangerous situation, such as being approached by an assailant. In these and other circumstances, the users depend on having a whistle easily available in a matter of a seconds. In addition, the whistle must be reliably secured to the product to ensure that the whistle does not detach during frequent (sometimes vigorous) use.

Prior attachment means used buckles or similar fasteners to attach whistles to various products, such as backpacks. This required the user to disengage the fasteners in order to use the whistle, which resulted in significant delay in readying the whistle. Additional prior attachment means used cords alone to attached the whistle. These means are also not ideal, as the whistle dangles freely from the cord, making it potentially difficult to grab the whistle when needed and increasing the chances that the whistle will detach from the product. Still other devices, such as that described in U.S. Pat. No. 7,043,802 (incorporated by reference in its entirety), attach the whistle to an awkward or inconvenient location, such as a zipper pull. None of these devices include means to reliably secure the whistle to the product while simultaneously allowing for easy access by the user. Thus, a new means for attaching a whistle to various products is required, in which the whistle is securely attached to the product yet also allows the user to easily retrieve the whistle.

SUMMARY OF INVENTION

The present invention generally relates to whistle attachment systems having a fixed component, a free component including a whistle, and two attachment mechanisms for connecting the free component to the fixed component. The first attachment mechanism includes a piping piece and a flange of the fixed component, which cooperate with a receiving portion and slot of the free component, respectively. The second attachment mechanism includes a flexible member, such as a lanyard that is attached to both the free component and the fixed component. The fixed component is fixedly attached to a product, such as a jacket, vest, or backpack.

The invention may be embodied in numerous devices and through numerous methods and systems. The following detailed description, taken in conjunction with the accompanying drawings, discloses examples of the invention. Other embodiments, which incorporate some, all, or more of the features as taught herein, are also possible.

BRIEF DESCRIPTION OF THE DRAWINGS

The present invention will become more fully understood from the detailed description given below and the accompanying drawings. Theses drawings are meant only to be illustrative, and thus do not limit the present invention. Similarly, the following brief description of the drawings should not be interpreted as limiting the scope of the present invention.

DETAILED DESCRIPTION

The present invention generally relates to a whistle attachment system having a fixed component, a free component including a whistle, and two attachment mechanisms connecting the two. The whistle attachment system may be used in a broad variety of products, including (but not limited to) backpacks and other bags; vests, jackets, and other garments; tents and other temporary outdoor structures; as well as other outdoor equipment. This system allows the user to remove, use, and reattach a whistle using the first attachment mechanism, without completely separating the whistle from the product (e.g., a backpack) due to the second attachment mechanism. As used throughout this specification, "product" refers to the item to which the whistle attachment system is connected and includes any of the products listed above as well as others.

Figure 1:
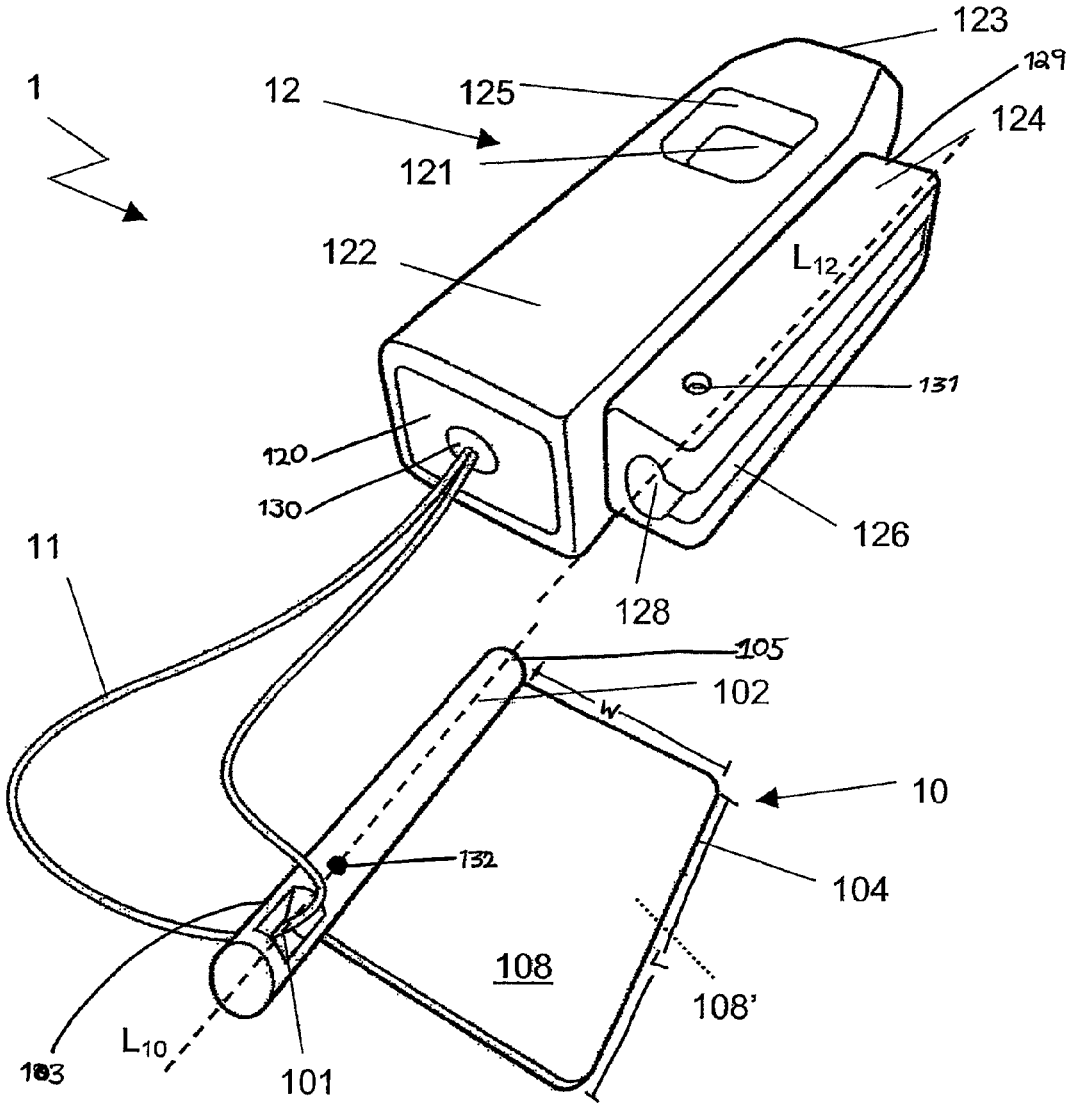
FIG. 1 is an isometric view of a whistle attachment system in accordance with certain embodiments of the present invention.

An example of a whistle attachment system in accordance with certain embodiments of the present invention is shown in FIG. 1. Whistle attachment system 1 includes fixed component 10, free component 12, and two attachment mechanisms connecting the two.

Fixed component 10 includes piping piece 102 and flange 104, which form the first half of the first attachment mechanism. Flange 104 is preferably planar, having opposing major surfaces top 108 and bottom 108'. In a preferred embodiment, flange 104 is rectangular, having a length L and a width W. At least a portion of fixed component 10, preferably a portion of flange 104, remains directly connected to the product at all times during use. The fixed component 10 may be permanently attached to the product, such as by sewing or permanent adhesive. Alternatively, fixed component 10 may be removably attached, such as by hook-and-loop fasteners or male-female fasteners, such as snaps. In these embodiments, the product would include the complementary part of the fastener. Fixed component 10 may be attached to the product in any other way known to those of skill in the art. Piping piece 102 is preferably cylindrical and has a length extending along a longitudinal axis $L_{10}$. Flange 104 extends from piping piece 102 along at least a portion of a minor surface of flange 104. In a preferred embodiment, flange 104 is connected to piping piece 102 along the minor surface of length L, which is parallel to longitudinal axis $L_{10}$.

Figure 2A:
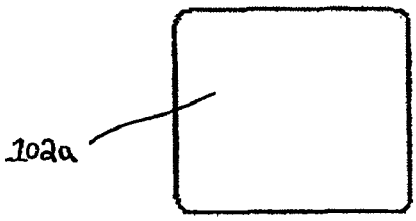
FIG. 2A is a cross-sectional view of a piping piece having a rectangular cross-section in accordance with certain embodiments.
Figure 2B:
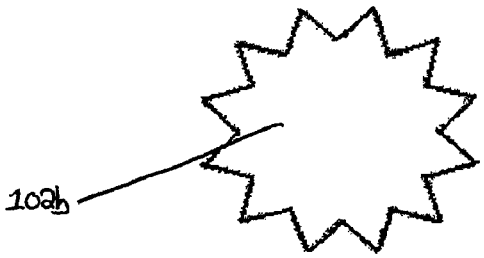
FIG. 2B is a cross-sectional view of a piping piece having a "star burst" cross-section in accordance with certain embodiments.
Figure 2C:
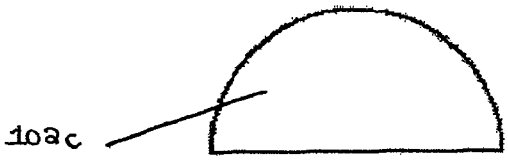
FIG. 2C is a cross-sectional view of a piping piece having a semi-circular cross-section in accordance with certain embodiments.
Figure 2D:
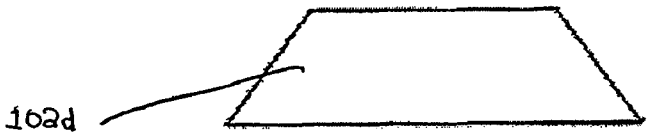
FIG. 2D is a cross-sectional view of a piping piece having a trapezoidal cross-section in accordance with certain embodiments.
Figure 2E:
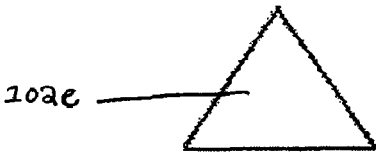
FIG. 2E is a cross-sectional view of a piping piece having a triangular cross-section in accordance with certain embodiments.

Piping piece 102 of fixed component 10, in accordance with certain embodiments of the present invention, is configured to be received by longitudinal cavity 128 of free component 12 and may comprise a broad variety of shapes and sizes. For example, piping piece 102 may have a circular cross-section as shown in FIG. 1, a rectangular cross-section as shown in FIG. 2A, a "star burst" cross-section of FIG. 2B, a semi-circular cross-section of FIG. 2C, a trapezoidal or dove-tail cross-section of FIG. 2D, or a triangular cross-section of FIG. 2E. However, numerous other configurations not shown here are also possible. Piping piece 102 also includes a projection 132 that is configured to be received in alignment hole 131 when the piping piece 102 is received in longitudinal cavity 128. Projection 132 may extend partially or fully through alignment hole 131, as shown in FIG. 4*c*.

Figure 3:
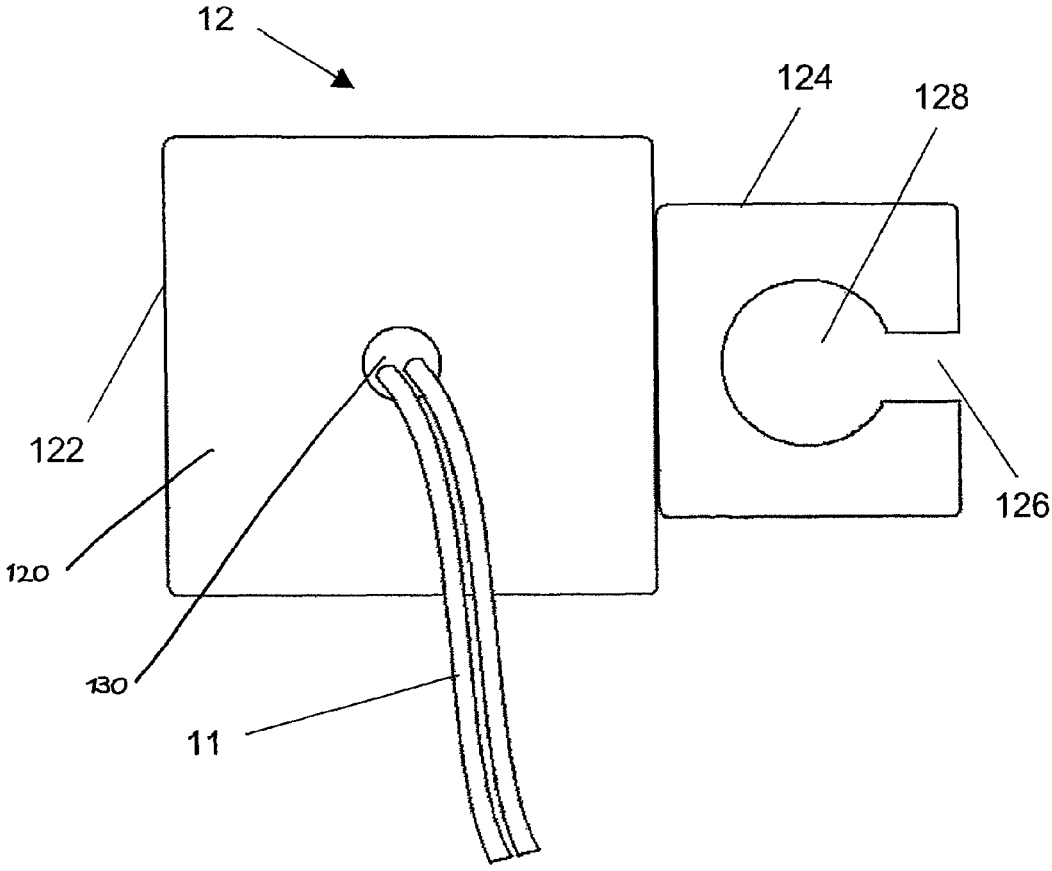
FIG. 3 is a bottom view of a free component of a whistle attachment system in accordance with certain embodiments.

Free component 12 includes whistle 122 and receiving portion 124. As shown in FIG. 1, whistle 122 includes hollow cavity 121 in fluid communication with a whistle inlet (not shown) on front face 123 of whistle 122, and with whistle outlet 125. Receiving portion 124 has a longitudinal axis $L_{12}$ and includes slot 126 and longitudinal cavity 128, which form the second half of the first attachment mechanism. Receiving portion 124 includes longitudinal cavity 128 for receiving piping piece 102 and slot 126 for receiving flange 104. As shown in FIGS. 1 and 3 for example, receiving portion 124 is attached to a side of whistle 122. Receiving portion 124 includes longitudinal cavity 128 in fluid communication with slot 126. Longitudinal cavity 128 may be cylindrical, as shown in FIG. 3, or may comprise a broad variety of shapes including but not limited to those shapes corresponding to piping pieces 102*a*, 102*b*, 102*c*, 102*d*, 102*e* shown in FIGS. 2A-2E. The cross-sectional shape of longitudinal cavity 128 is complementary to the cross-sectional shape of piping piece 102. The longitudinal cavity 128 receives piping piece 102, and surrounds a majority of the circumference of piping piece 102, preferably surrounding 60%, 70%, 80%, or 90% of the circumference of the piping piece 102. Slot 126 is shaped to receive a portion of flange 104, specifically being in contact with a portion of major surfaces top 108 and bottom 108'. Slot 126 may comprise a broad variety of configurations, other than the rectangular profile shown in FIG. 3. The top of receiving portion 124 has a closed end 129 that acts as a stop for the top end 105 of piping piece 102 when free component 12 is connected to fixed component 10.

Figure 4A:
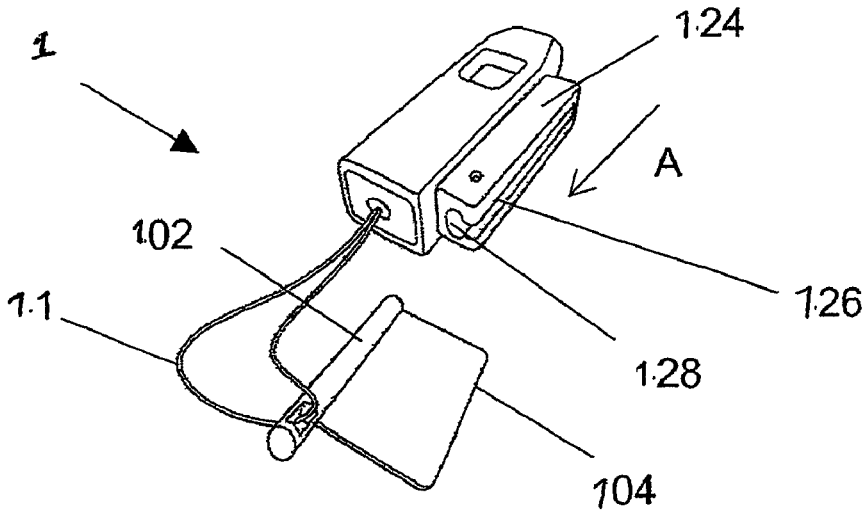
FIG. 4A is an isometric view of a whistle attachment system in accordance with certain embodiments, in which the free component is not engaged with the fixed component.
Figure 4B:
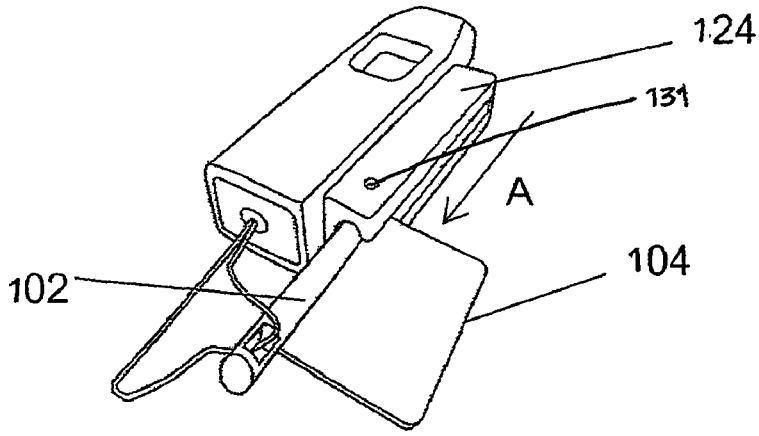
FIG. 4B is an isometric view of a whistle attachment system in accordance with certain embodiments, in which the free component is partially engaged with the fixed component.
Figure 4C:
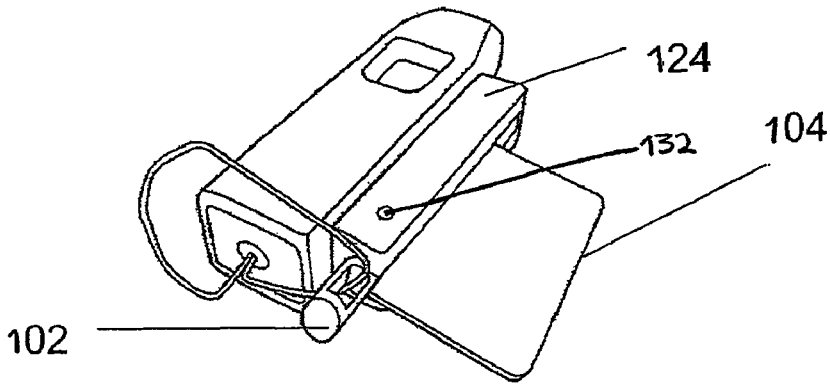
FIG. 4C is an isometric view of a whistle attachment system in accordance with certain embodiments, in which the free component is fully engaged with the fixed component.

Receiving portion 124 is configured to slidably receive piping piece 102 and flange 104, as shown in FIGS. 4A-4C. When free component 12 is engaged with the fixed component 10 (as shown in FIGS. 4B and 4C for example), longitudinal axes $L_{10}$ and $L_{12}$ are co-linear with one another. During use of the whistle for example, the fixed component 10 and free component 12 may be connected only by second attachment mechanism, comprising flexible member 11, which allows a user to have greater control over the positioning of the whistle 122. When the user desires to re-secure the whistle 122 to the product, the free component 12 is slid onto the fixed component 10 in the direction of arrow A. This is achieved by sliding longitudinal cavity 128 of receiving portion 124 onto piping piece 102. Simultaneously, slot 126 is slid onto flange 104. As shown in FIG. 4C, the entirety of piping piece 102 and/or flange 104 need not be received by receiving portion 124. As that shown in FIG. 4C, at least a portion of the major surfaces 108, 108' of flange 104 are exposed, allowing a portion of major surfaces 108, 108' to attach to a product.

Free component 12 is also connected to fixed component 10 via a second attachment mechanism, which includes flexible member 11. Flexible member acts as a tether that links the two components together. The flexible member 11 may attach to the free component 12 and fixed component 10 in a broad variety of ways. In embodiments such as that shown in FIG. 1 for example, flexible member 11 may loop through hole 101 in fixed component 10. In this embodiment, hole 101 is provided in a bottom section 103 of piping piece 102, and is preferably located below the attachment point of flange 104 to piping piece 102. Flexible member 11 can thus slide through hole 101. Alternatively, hole 101 can be provided in flange 104. The two ends of flexible member 11 may be connected to a bottom surface 120 of free component 12 at attachment point 130. The ends of flexible member 11 may include a knot received through a hole at attachment point 130, or may be fixedly bonded to the free component 12 in any other way, such as by adhesive. In additional embodiments (not shown), the flexible member 11 may similarly loop through a hole in the free component 12 to attach to the free component 12. In other embodiments, a flexible member 11 does not loop through a hole in at least one component, but is instead integrally connected, such as by adhesive, to one or both of fixed component 10 and free component 12 like a tether or leash. Alternatively, one or both ends of flexible member 11 could include a clip or clasp to be attached to a projection of fixed component 10 or free component 12. In still other embodiments (not shown), the flexible member is fed through a hole in the body of either component and tied in a knot at the end to prevent the flexible member from pulling out of the hole. In additional embodiments (not shown), the flexible member is retractable within one or both of the components, and may include a spring and an internal reel for receiving the flexible member therearound, similar to the way a typical tape measure might function.

Accordingly, the flexible member 11 may comprise any flexible or bendable material suitable for achieving this task. Non-limiting examples of suitable flexible members include elastic cords, cables, chains, links, strings, bands, or straps. The flexible member may be fabricated from a broad variety of materials, including (but not limited to) rubber, plastics, elastomers, nylon, various fabrics, metals or alloys, or any other stretchable or flexible material. The flexible member may comprise a broad range of thicknesses and lengths and may have a diverse array of cross-sectional shapes. In certain embodiments, the flexible member is a lightweight cord. In additional embodiments (not shown), the flexible member is a chain or similar linkage, which may be fabricated from plastics, rubbers, ceramics, or lightweight metals and other alloys.

The piping piece 102 and flange 104 of the fixed component 10 may be fabricated from a broad variety of materials. Non-limiting examples of such materials include various fabrics, polymers, rubbers, light metals and other alloys, and any other material known to those of skill in the art suitable for attachment to the products listed above (e.g., backpacks, vests, etc.). The whistle 122 and receiving portion 124 of the free component may be fabricated from a broad variety of materials, including, but not limited to, any of the materials suitable for fabrication of the fixed component.

The whistle 122 may be designed such that a loud, piercing sound emanates from the whistle when a user blows into the whistle inlet. A whistle 122 in accordance with the present invention may be any known whistle. Non-limiting examples include hunting whistles, dog whistles, and various panic whistles. The whistle may assume a broad variety of configurations and may be configured to emanate notes of any desired pitch, frequency, or volume. For example, the whistle 122 may have the elongate shape as shown in FIG. 1, or it may have the curved shape as shown in U.S. Pat. No. 4,359,961 (the entirety of which is incorporated herein by reference). Additionally, the whistle may have one chamber, or it may have several chambers, such as the whistles shown in U.S. Pat. No. 4,821,670 (the entirety of which is incorporated herein by reference).

Figure 5:
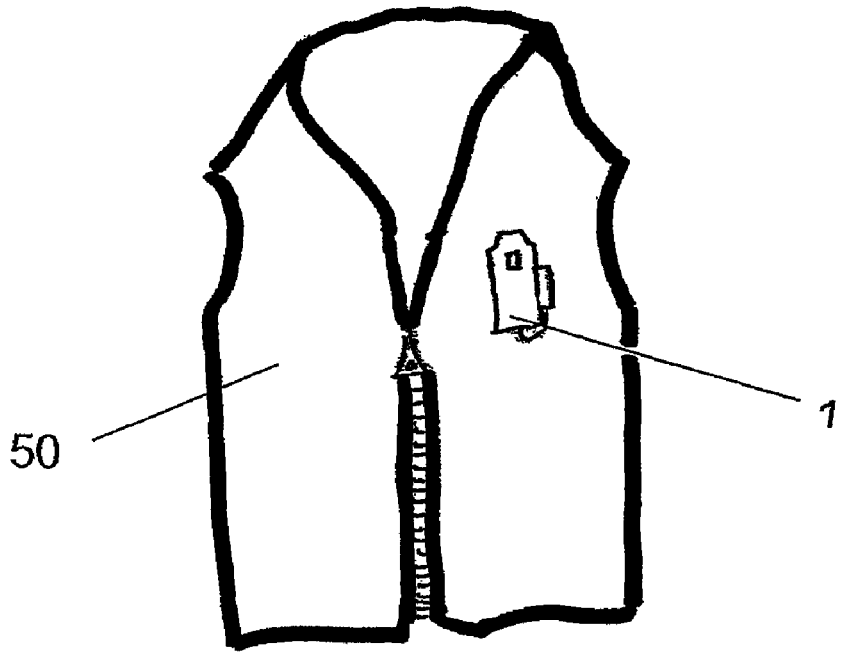
FIG. 5 is a front view of a vest having a whistle attachment system in accordance with certain embodiments.
Figure 6:
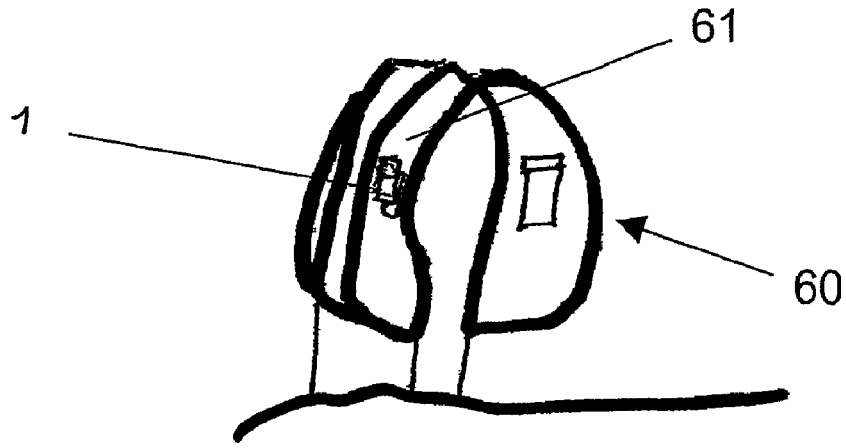
FIG. 6 is a front view of a backpack having a whistle attachment system attached to a strap of the backpack in accordance with certain embodiments.

The whistle attachment system described above may be attached to a variety of products and on a broad variety of locations on the product. For example, a whistle attachment system 1 in accordance with certain embodiments could be located on a front of a vest 50, as shown in FIG. 5 for example. In another example, a whistle attachment system 1 could be located on a strap 61 of a backpack 60, as shown in FIG. 6 for example. Additionally, a whistle attachment system 1 may be attached to the side or front face of a backpack or other pack. These examples are but a few of many possibilities and should not be interpreted as limiting the scope of the present invention in any way.

While a single whistle attachment system has been described, two or more whistle attachment systems of varying configurations may be attached to a single product. Further, while the configurations shown in the accompanying figures depict only a single whistle in each system, one or more whistles may be used in a single system, as needed. For example, a single fixed component could have several piping pieces, allowing for several free components to be attachable to a single fixed component.

While various embodiments have been described, other embodiments are plausible. It should be understood that the foregoing descriptions of various examples of a whistle attachment system are not intended to be limiting, and any number of modifications, combinations, and alternatives of the examples may be employed to facilitate the effectiveness of reliably securing a whistle to an article while simultaneously allowing a user quick and easy access to the whistle.

The examples described herein are merely illustrative, as numerous other embodiments may be implemented without departing from the spirit and scope of the exemplary embodiments of the present invention. Moreover, while certain features of the invention may be shown on only certain embodiments or configurations, these features may be exchanged, added, and removed from and between the various embodiments or configurations while remaining within the scope of the invention. Likewise, methods described and disclosed may also be performed in various sequences, with some or all of the disclosed steps being performed in a different order than described while still remaining within the spirit and scope of the present invention.

What is claimed is:

1. A whistle attachment system, comprising:

a fixed component, comprising:

a piping piece having a longitudinal axis; and a flange attached to at least a portion of the piping piece;

a free component, comprising:

a whistle; and a receiving portion having a longitudinal axis, a longitudinal cavity, and a slot; and a flexible member connecting to the free component and the fixed component, wherein the longitudinal cavity is configured to receive the piping piece and the slot is configured to receive the flange.

2. The whistle attachment system of claim 1, wherein the flexible member comprises an elastic cord, a cable, a chain, or a lanyard.

3. The whistle attachment system of claim 1, wherein the flexible member is retractable within at least one of the free component and the fixed component.

4. The whistle attachment system of claim 1, wherein the flexible member is slidably attached to the fixed component through a hole in the piping piece.

5. The whistle attachment system of claim 4, wherein the flexible member is fixedly attached to a bottom surface of the free component.

6. The whistle attachment system of claim 5, wherein the flexible member is received through a hole in a bottom surface of the free component.

7. The whistle attachment system of claim 6, wherein at least one end of the flexible member is knotted.

8. The whistle attachment system of claim 1, wherein the longitudinal cavity surrounds a majority of the outer surface of the piping piece.

9. The whistle attachment system of claim 1, wherein the piping piece is cylindrical and the longitudinal cavity surrounds 80% of the circumference of the piping piece.

10. The whistle attachment system of claim 1, wherein the flange is planar and the slot is rectangular.

11. The whistle attachment system of claim 1, wherein the receiving portion has a closed top end that acts as a stop for a top end of the piping piece, when the piping piece is received within the longitudinal cavity.

12. The whistle attachment system of claim 1, wherein the longitudinal axis of the piping piece and the longitudinal axis of the receiving portion are co-linear when the piping piece is received within the longitudinal cavity and the flange is received in the slot.

13. A backpack comprising the whistle attachment system of claim 1, wherein the flange of the fixed component is attached to the backpack.

14. The backpack of claim 13, wherein the flange is sewn into the backpack.

15. The backpack of claim 13, wherein the flange is attached to the backpack using hook and loop fasteners or an adhesive.

16. A garment comprising the whistle attachment system of claim 1, wherein the flange of the fixed component is attached to the garment.

17. The garment of claim 16, wherein the flange is sewn into the garment or is attached using hook and loop fasteners or snaps.

18. The garment of claim 16, wherein the garment is a jacket or a vest.

19. A whistle attachment system, comprising:

a fixed component;

a free component comprising a whistle;

a first attachment mechanism for attaching the free component to the fixed component comprising:

a piping piece and an extending flange on the fixed component; and a longitudinal cavity and a slot on the free component, wherein the longitudinal cavity is configured to receive the piping piece and the slot is configured to receive the extending flange; and a second attachment mechanism for attaching the free component to the fixed component comprising a flexible member.

20. The whistle attachment system of claim 19, wherein the first attachment mechanism is releasable and the second attachment mechanism is permanent.

* * * * *